US008548368B2

(12) United States Patent
Hollands et al.

(10) Patent No.: US 8,548,368 B2
(45) Date of Patent: Oct. 1, 2013

(54) METHOD AND APPARATUS FOR FUSING A RECORDING MATERIAL ON A MEDIUM

(75) Inventors: Peter J. Hollands, Baarlo (NL); Fredericus P. H. Theunissen, Oirlo (NL)

(73) Assignee: Oce Technologies B.V., Venlo (NL)

( * ) Notice: Subject to any disclaimer, the term of this patent is extended or adjusted under 35 U.S.C. 154(b) by 43 days.

(21) Appl. No.: 13/204,766

(22) Filed: Aug. 8, 2011

(65) Prior Publication Data

US 2011/0286776 A1 Nov. 24, 2011

Related U.S. Application Data

(63) Continuation of application No. PCT/EP2010/051071, filed on Jan. 29, 2010.

(30) Foreign Application Priority Data

Feb. 10, 2009 (EP) ..... 09152455

(51) Int. Cl.
*G03G 15/20* (2006.01)

(52) U.S. Cl.
USPC ..... 399/331; 399/335; 399/336

(58) Field of Classification Search
USPC ..... 399/331, 336, 335
See application file for complete search history.

(56) References Cited

U.S. PATENT DOCUMENTS

| | | | | | |
|---|---|---|---|---|---|
| 3,811,821 | A * | 5/1974 | Ariyama et al. | 432/8 |
| 4,071,735 | A * | 1/1978 | Moser | 219/216 |
| 4,148,937 | A * | 4/1979 | Kurachi et al. | 430/124.33 |
| 4,197,445 | A * | 4/1980 | Moser | 219/216 |
| 4,416,719 | A * | 11/1983 | Horiuchi | 156/359 |
| 4,567,349 | A * | 1/1986 | Henry et al. | 219/216 |
| 5,055,884 | A * | 10/1991 | Ndebi et al. | 399/320 |
| 5,182,606 | A * | 1/1993 | Yamamoto et al. | 399/335 |
| 5,499,089 | A * | 3/1996 | Tsukamoto et al. | 399/328 |
| 5,636,349 | A * | 6/1997 | Landa et al. | 399/307 |
| 5,784,679 | A * | 7/1998 | Schlueter et al. | 399/335 |
| 5,872,350 | A * | 2/1999 | Moser | 219/216 |
| 5,887,238 | A * | 3/1999 | Matsuzoe et al. | 399/336 |
| 5,933,695 | A * | 8/1999 | Henry et al. | 399/333 |
| 6,898,410 | B2 * | 5/2005 | Boss | 399/330 |
| 7,076,198 | B2 * | 7/2006 | Kim et al. | 399/330 |
| 7,236,732 | B2 * | 6/2007 | Cao et al. | 399/328 |
| 7,809,316 | B2 * | 10/2010 | Van Sas et al. | 399/307 |
| 2002/0094220 | A1 | 7/2002 | Bartscher et al. | |

(Continued)

FOREIGN PATENT DOCUMENTS

| | | |
|---|---|---|
| EP | 0 654 716 B1 | 12/1998 |
| EP | 1 217 458 B1 | 7/2007 |

(Continued)

*Primary Examiner* — Walter L Lindsay, Jr.
*Assistant Examiner* — David Bolduc
(74) *Attorney, Agent, or Firm* — Birch, Stewart, Kolasch & Birch, LLP

(57) ABSTRACT

In a method for fusing a recording material on a medium, a fusing element is radiated close to and upstream from a fuse nip. Thus, the heat that is provided has very little time to penetrate the fusing element and thus remains at a surface of the fusing element. Therefore, the fusing element does not need to be heated thoroughly, which would require a substantial amount of time. Consequently, in the method, heat may be provided on demand and an energy efficient fuse method is thus provided.

19 Claims, 4 Drawing Sheets

(56) References Cited

U.S. PATENT DOCUMENTS

| | | | | |
|---|---|---|---|---|
| 2003/0160039 | A1* | 8/2003 | Eskey | 219/216 |
| 2005/0207807 | A1* | 9/2005 | Tombs | 399/341 |
| 2008/0124148 | A1* | 5/2008 | Kim et al. | 399/331 |
| 2010/0111580 | A1* | 5/2010 | Choi et al. | 399/333 |
| 2010/0254738 | A1* | 10/2010 | Kagawa | 399/341 |
| 2011/0222936 | A1* | 9/2011 | Matsubara et al. | 399/336 |

FOREIGN PATENT DOCUMENTS

| | | | | |
|---|---|---|---|---|
| EP | 1 927 901 | A1 | | 6/2008 |
| FR | 1492748 | | | 8/1987 |
| JP | 53006044 | A | * | 1/1978 |
| JP | 54137342 | A | * | 10/1979 |

* cited by examiner

METHOD AND APPARATUS FOR FUSING A RECORDING MATERIAL ON A MEDIUM

This application is a Continuation of PCT International Application No. PCT/EP2010/051071 filed on Jan. 29, 2010, which claims priority under 35 U.S.C §119(a) to Patent Application No. 09152455.3 filed in Europe on Feb. 10, 2009, all of which are hereby expressly incorporated by reference into the present application.

The present invention relates to a method and an apparatus for fusing a recording material such as toner or ink on a recording medium such as paper or the like.

For fusing a recording material on a medium, several methods are known. In general, heat is used to heat the recording material and the medium such that the recording material is softened enabling the recording material to become attached to the medium. For providing heat, it is well known to provide heat radiation generated by a suitable device, such as a lamp. Further, in order to provide as much radiation generated by the lamp to the recording material and medium, it is known to use a reflector assembly. An exemplary reflector assembly is known from the French patent FR 1.492.748.

In an embodiment disclosed in the above-mentioned patent, a reflector assembly comprises two curvilinear reflector sections which preferably are elliptical. Both elliptical reflector sections have two focal points of which two substantially coincide and at which a radiation source is located. The second focal points (f2 and f2' in FIG. 7 of FR 1.492.748) of both reflector sections are situated in a plane, spatially separated from each other. The radiation is focused towards both the second focal point of the first elliptical reflector section (f2) and the second focal point of the second elliptical reflector section (f2'), thus providing a region having an elevated temperature, including two 'hot-spots', on an underlying surface.

In particular, this prior-art method of heating a surface results in heating not only the surface but also the material underlying the surface as the heat is provided with sufficient time to penetrate the surface and the underlying material. Hence, a relatively large amount of heat is needed for obtaining a desired elevated temperature at the surface. Further, the prior-art assembly for heating needs a relatively large space near the location of heating, e.g. for heating an image receiving medium, e.g. a sheet of paper, which is transported through the heated region. Hence, such an assembly significantly limits the design options for any device incorporating such a heating assembly.

In another known method, fusing is performed using a combination of heat and pressure. In such a known fusing method, the pressure is provided by a fusing nip and the heat is provided by any of the elements forming the nip. Such a fusing assembly is described e.g. in EP 1927901 A1, in which a heater is arranged inside a fusing roller, which is thus provided with heat on an inner surface for heating the fusing roller such that the temperature at an outer surface becomes sufficiently high for fusing a recording material.

Such heating of at least one of the elements of the fusing nip requires a relatively large amount of energy. As the temperature needs to be relatively high compared to e.g. a normal room temperature, a relatively long period of time is needed to heat such an element and in order to keep a waiting period for a user short, it is required to keep the heated fusing element at the required, elevated fusing temperature. Further, such an element may have a relatively high mass, requiring relatively large amount of energy for heating the entire mass of the element to the fusing temperature, or at least to a temperature close to the fusing temperature.

It is an object of the present invention to provide a fusing method—and an apparatus employing such a method—which requires a relatively small amount of energy. This object is achieved by a method according to claim 1, wherein the method comprises generating heat radiation and providing the heat radiation on the surface of a fusing element close to and upstream from the fusing nip for heating said surface to a fusing temperature. It is noted that the heat is provided on the surface that, in the fusing nip, is in contact with the recording material and medium for fusing the recording material on the medium. Hereinafter, this surface may be referred to as the fusing surface. The recording material is fused onto the medium by transporting the medium and the recording material through the fusing nip, in which nip the fusing surface provides the required heat.

In an embodiment, the method comprises transferring the recording material—such as toner or ink—to the fusing surface of the fusing element, while the fusing surface of the fusing element has a transfer temperature. The fusing element transports the recording material to the fusing nip. In the fusing nip, the recording material and the medium meet and due to the heat on the fusing surface and due to the pressure, the recording material is fused onto the medium.

In another embodiment, the recording material is transferred to the medium. Then, the medium carrying the recording material is transported to the fusing nip. Just upstream of the fusing nip, the fusing surface of the fusing element is heated and the provided heat is transported by the fusing element to the fusing nip, in which the heat and pressure provide fusing of the recording material on the medium.

In the method according to the present invention, the heat required for fusing is provided to the fusing element shortly before the recording material and the medium reach the fuse nip. Thus, the heat provided to the fusing element has only a short time to penetrate the fusing element and is thus only enabled to penetrate a thin surface layer of the fusing element before reaching the fuse nip. In the fuse nip, as the heat has been provided on the fusing surface, the heat is available at the surface for fusing the recording material. Hence, no heat is transported any further into the fusing element and only the heat needed for fusing needs to be provided to the fusing element. As a result, only little heat is needed as substantially no heat is lost for heating a mass of the fusing element and as substantially no heat is lost to the surroundings.

In an embodiment of the method the heat radiation is being focused at the surface of the fusing element. Thus, a relatively large amount of the generated heat may be provided to the fusing element close to the fuse nip, limiting a loss of heat.

In one of the above indicated embodiments, the method comprises, prior to the above-described steps, the steps of transferring the recording material to the fusing surface of the fusing element, the surface of the fusing element having a transfer temperature and the fusing element transporting the recording material to the fusing nip. For transferring the recording material—such as toner—to the fusing element—such as a fuse roller or fuse belt—the temperature of the fuse element needs to be relatively low compared to the fuse temperature. As the method according to the present invention provides the advantage that the fusing element is only heated at its surface just before the fuse nip, the temperature of the surface of the fusing element arrives relatively quickly at such a relatively low (transfer) temperature after fusing.

The present invention further provides an apparatus in accordance with claim 3, which apparatus employs the method according to the present invention. In an embodiment of the apparatus, the heat device comprises a reflector assembly. The reflector assembly has a cross-section, which cross-section comprises a first elliptical reflector section having a first focal point and a second focal point;

a second elliptical reflector section having a third focal point and a fourth focal point;

and a third reflector section arranged for reflecting a portion of radiation first reflected by the second reflector section, wherein the first, second and third reflector sections are arranged such that the first focal point and the third focal point substantially coincide and such that the third reflector section mirrors the fourth focal point substantially towards the second focal point and such that the second focal point and the mirror image of the fourth focal point are substantially located on the surface of the fusing element close to and upstream from the fuse nip.

The reflector assembly of the heating device reflects radiation in such a way that a narrow region of a surface may be radiated in an effective way. The reflector assembly is compact and the larger elements of the heating device, such as the heat radiation generating element, may be arranged at a location at a distance from the region of the surface to be heated. As the reflector assembly is capable of reflecting radiation in a narrow region of a surface, the surface is efficiently heated such that substantially only the surface is heated and less energy is lost in the material underlying the surface.

It is noted that for obtaining a narrow region to be heated, the surface to be heated is to be arranged in the second focal point as most radiation is concentrated in the second focal point. However, if a larger region should be heated, the surface may be arranged at a distance from the second focal point, as the heating radiation diverges from the second focal point as readily understood by a person skilled in the art.

Further, it is contemplated that the third reflector section does not mirror the fourth focal point exactly onto the second focal point such that the radiation first reflected by the second reflector section is directed substantially towards the second focal point but is not focussed in the second focal point. In such an embodiment, the radiation reflected by the first reflector section is focussed in the second focal point, while the radiation first reflected by the second reflector section provides a relatively small, but still a region larger than when focussed, around the second focal point. Thus, a relatively small heating region may be provided having a hot spot.

In an embodiment the third reflector section is a plane shaped reflector section.

The inventors have found this to be a suitable and cost-effective embodiment. However, it is noted that also other shapes of the third reflector section may be used depending on the application and requirements.

In an embodiment the heating device extends in a first direction from a first end section to a second end section and the heating device comprises at least one further radiation source, the at least one further radiation source being arranged at one of said first and second end sections. Such an embodiment may be advantageous, when starting up the heating process. During start-up the end portions of the heat radiation generating element tend to heat up more slowly than the mid-section of the heat radiation generating element. The at least one further radiation source compensates for this, resulting in a more uniform heating of the underlying surface and hence in a more uniform temperature profile of heated region of the underlying surface.

It is noted that a good result, i.e. a uniform temperature of the fusing element from the first end section to the second end section, is obtained when the further radiation source is positioned in the reflector assembly such that a effective length of an radiation path extending from the further radiation source to the surface of the fusing element is substantially equal to the effective length of an radiation path extending from the heat radiation generating element (e.g. a first radiation source) to the surface of the fusing element. Such a path is determined by the reflections on the reflector assembly and hence the further radiation source is preferably arranged such that a large amount of the radiation arrives at the surface of the fusing element with no more than two reflections. A person skilled in the art readily understands how and where the further radiation source may be arranged in accordance with this preferred arrangement.

In an embodiment the apparatus is configured such that the arc of circle extending from the fuse nip to the location of the second focal point and the mirror image of the fourth focal point on the fusing element is less than 70 degrees, preferably less than 65 degrees, more preferably less than 60 degrees and even more preferably less than 55 degrees. The apparatus thus enables effectively heating of a narrow region of the surface of the fusing element, very near to the fuse nip, where the heat is required.

The invention will now be explained in more detail with reference to the appended drawings showing non-limiting embodiments and wherein:

FIGS. 1A and 1B schematically illustrate a first embodiment of a reflector assembly for use in an apparatus according to the present invention;

FIGS. 2A and 2B schematically illustrate a second embodiment of a reflector assembly for use in an apparatus according to the present invention;

Figure 1A:
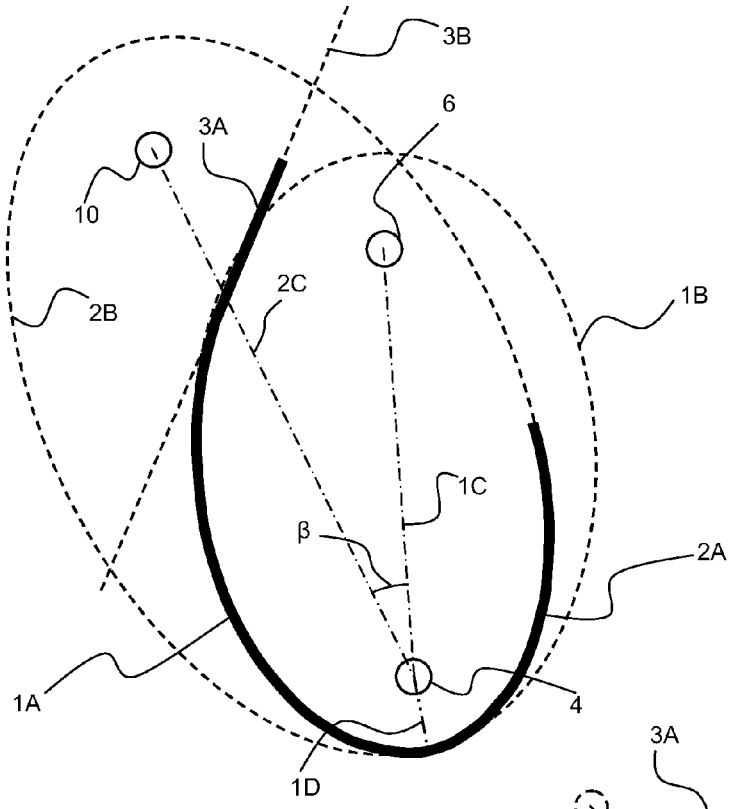

In the drawings, like reference numerals refer to like elements. First, two exemplary embodiments of a reflector assembly for use in the apparatus according to the present invention are elucidated. It is noted that the reflector assembly may as well be employed in any other kind of heating device, i.e. a heating device not used in a fusing method according to the present invention.

FIG. 1A shows a cross-section of a reflector assembly comprising a first reflector section 1A, a second reflector section 2A and a third reflector section 3A.

The first reflector section 1A is elliptically shaped and may be regarded as a part of a first virtual ellipse 1B having a first focal point 4 and a second focal point 6. A distance between the first focal point 4 and the second focal point is hereinafter referred to as a first ellipse axis and is indicated by reference numeral 1C and a shortest distance between the first focal point 4 and the first virtual ellipse 1A is indicated by reference numeral 1D. These two distances 1C, 1D define the shape and size of the first virtual ellipse 1A as readily understood by one skilled in the art.

The second reflector section 2A is elliptically shaped and may be regarded as a part of a second virtual ellipse 2B having a third focal point coinciding with the first focal point 4 and a fourth focal point 10. A distance between the third focal point (i.e. first focal point 4) and the fourth focal point is hereinafter referred to as a second ellipse axis and is indicated by reference numeral 2C and a shortest distance between the first focal point 4 and the second virtual ellipse 2A is indicated by reference numeral 1D. These two distances 2C, 1D define the shape and size of the second virtual ellipse 2A. The first and the second ellipse axes 1C and 2C are arranged at an angle β.

Further, FIG. 1A shows a virtual line 3B illustrating a line through and parallel with the third reflector section 3A. The third reflector section 3A is arranged such that the fourth focal point 10 is mirrored towards—in this embodiment substantially onto—the second focal point 6.

Figure 1B:
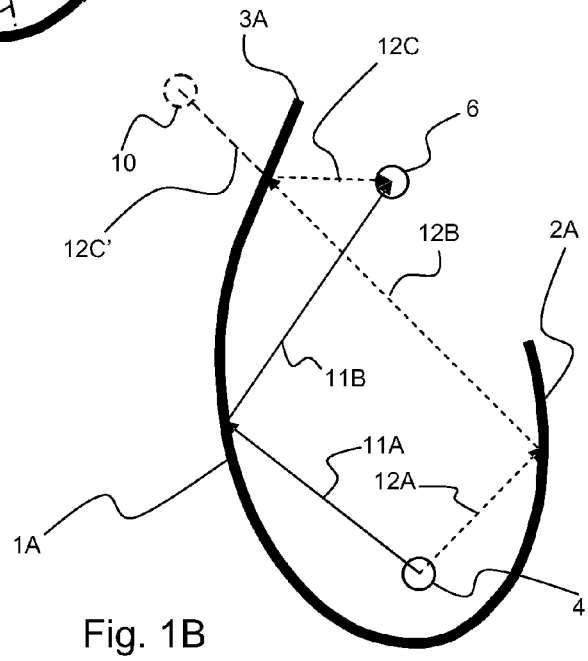

Now referring to FIG. 1B, showing the reflector assembly of FIG. 1A, the operation of the reflector assembly is elucidated. Considering that any beam of radiation originating from a first focal point of an ellipse will arrive at a second focal point of said ellipse, two beams of radiation 11A, 12A are shown. These beams 11A, 12A may be generated by any suitable radiation source arranged in the first focal point 4 of the reflector assembly. The first beam 11A reflects at the first reflector section 1A and thus is reflected to the second focal point 6 as illustrated by a reflected beam 11B. The second beam 12A reflects at the second reflector portion 2A and is directed towards the fourth focal point 10 as illustrated by reflected beam 12B and virtual reflected beam 12C'. However, upon impingement on the third reflector section 3A, the beam is then reflected towards the second focal point 6. Thus, a relatively large part of the radiation emitted at the first focal point 4 is reflected to and focussed in the second focal point 6 either via the first reflector section or via the second and third reflector section.

In an exemplary embodiment, a length of the first ellipse axis 1C is about 32, a length of the second ellipse axis 2C is about 44, the distance 1D between the first focal point 4 and the first and second virtual ellipses 1A, 2A is about 6 and the angle β is about 22,6o. It is noted that the above indicated lengths are in arbitrary units, merely showing a relative size of each of the indicated lengths.

Figure 2A:
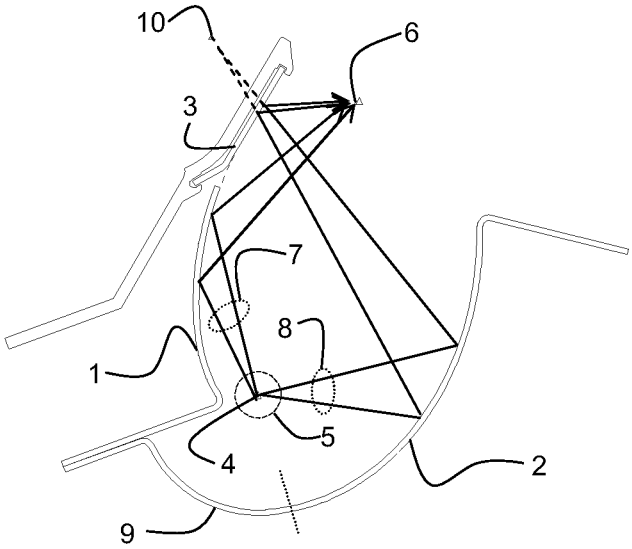

FIG. 2A shows a schematical representation of a cross-section of another embodiment of a suitable reflector assembly. The reflector assembly comprises: a first elliptical reflector section 1 with a first focal point 4 and a second focal point 6; a second elliptical reflector section 2 with a third focal point, which substantially coincides with the first focal point 4, and a fourth focal point 10; and a third reflector section 3. The first, second and third reflector sections are arranged such that the third focal point substantially coincides with the first focal point 4, and such that the third reflector section 3 reflects a portion of radiation 8 that is first reflected by the second elliptical reflector section 2 and such that the third reflector section 3 creates a mirror image of the fourth focal point 10. The mirror image of the fourth focal point 10 substantially coincides with the second focal point 6. In this particular example, the third reflector section is a planar reflector section. The third reflector section 3 may, however, be of any shape, as long as it reflects radiation first reflected by the second reflector section 2 substantially towards the second focal point 6.

Figure 2B:
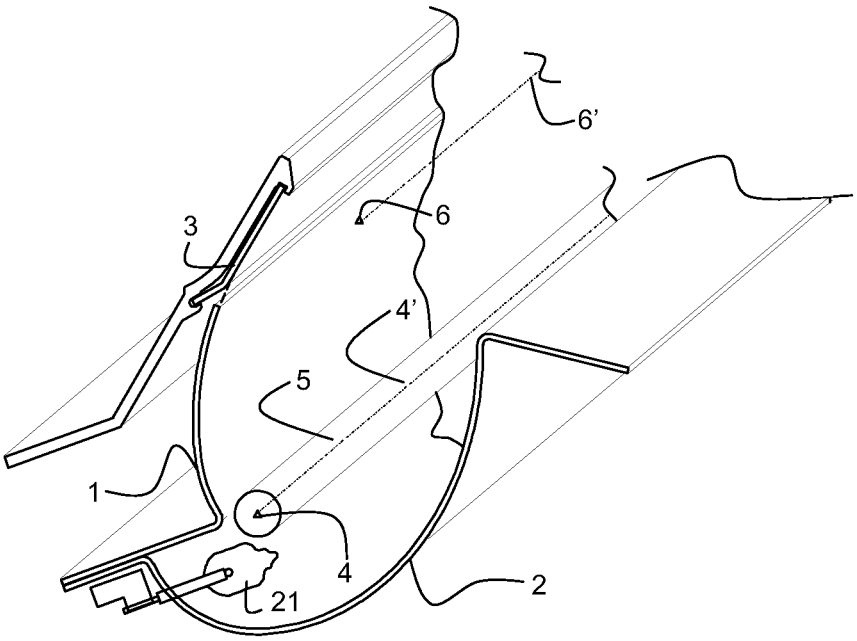

FIG. 2B shows an embodiment of a reflector assembly having a cross-section as shown in FIG. 2A. The illustrated embodiment is an elongated reflector assembly providing a focal line. In another embodiment, the reflector assembly may be e.g. circularly shaped resulting in a focal point instead of a focal line.

Now referring to FIGS. 2A and 2B, an elongated radiation source 5 may be arranged at the first focal point 4, which is actually a focal line 4' (FIG. 2B) extending from a first lateral end section of the reflector assembly towards a second lateral end section of the reflector assembly.

FIG. 2A shows that a first portion of the radiation generated by the radiation source 5 may be reflected once by the first elliptical reflector section 1, towards the second focal point 6, which is shown by the radiation rays indicated with number 7. A second portion (i.e. radiation rays indicated with number 8) of said radiation is reflected twice: firstly by the second elliptical reflector section 2, towards the fourth focal point; and secondly by the third reflector section 3 substantially towards the mirror image of the fourth focal point, which substantially coincides with the second focal point 6.

In the illustrated embodiment, the reflector assembly further comprises a circular shaped part 9. This circular shaped part 9 is arranged for reflecting a portion of radiation, coming from the radiation source 5, which otherwise would not reach its target (i.e. the second focal point 6). In this embodiment, this portion of the radiation is reflected back to the radiation source 5 arranged in the first focal point 4 and may thereafter be reflected by the second reflector portion 2. This is particularly advantageous for improving the efficiency of a heating device comprising such a reflector assembly. Radiation sources may need to reach a certain temperature to obtain a desired radiation spectrum. Coupling back the said portion of radiation to the radiation source may accelerate the heating up of the radiation source itself. Further, loss of radiation due to scattering at a surface of the radiation source 5 is reduced.

Figure 3:
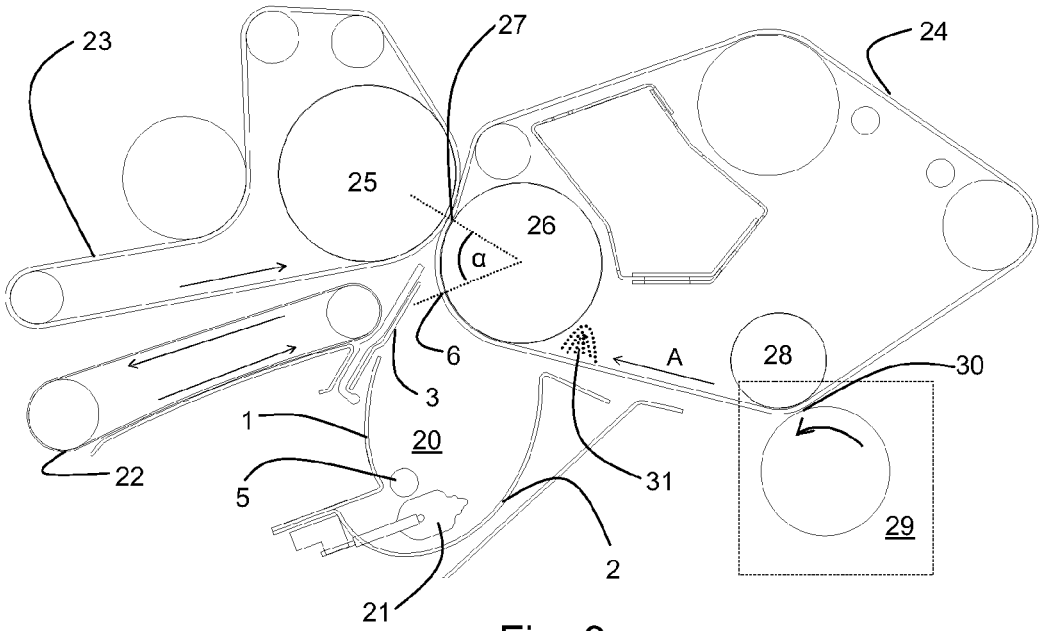
FIG. 3 shows a schematical representation of a cross-section of an apparatus according to the present invention.

FIG. 3 shows a schematical representation of an embodiment of an apparatus according to the present invention comprising a heating device 20. The heating device 20 comprises a reflector assembly as shown in and described in relation to FIG. 2A-2B. The reference numbers 1, 2, 3, 5 and 6 correspond to the elements shown in FIGS. 2A and 2B and are described above.

FIG. 3 further shows a transfer and transfuse belt (TTF) 24 trained over a plurality of rollers amongst which roller 28 which forms a transfer nip 30 with an image forming device 29; an exit belt 23 trained over a plurality of rollers; a pre-heating station arranged for pre-heating the image receiving media (e.g. a sheet of paper), the pre-heating station comprising a transport belt 22. The TTF-belt 24 and the exit belt 23 are arranged such, that a transfuse nip 27 is formed between pressure rollers 25 and 26. In the printing process, a toner image is formed with image forming device 29 and transferred to a surface of the TTF-belt 24 in transfer nip 30. The transferred image is then transported with transport belt 22 towards the transfuse nip 27. In the transfuse nip 27, the toner image is transferred and fused onto the receiving material.

For fusing the image onto the receiving material, heat is required to bring the toner particles in a malleable state such that the toner particles can be fixed onto the receiving material with pressure provided by the transfuse nip 27. On the other hand, for transferring the image from the image forming device 29 to the surface of the TTF-belt 24 in transfer nip 30 it is important that the toner particles are in a solid state, thus at a lower temperature than in the transfuse nip 27. The TTF-belt 24 runs in a direction indicated with arrow A in FIG. 3 and passes through both the transfer nip 30 and the transfuse nip 27.

The TTF-belt 24 is at a relatively low transfer temperature when passing through the transfer nip 30 and at a relatively high fuse temperature when passing through the fuse nip 27. Therefore, the TTF-belt 24 needs to be heated prior to fusing an image onto an image receiving medium and needs to cool down prior to the subsequent image transfer in nip 30. Furthermore, for efficiency reasons it is desired that the TTF-belt 24 is heated on demand (i.e. only when an image needs to be fused onto a receiving medium) which is obtained by providing heat radiation to the TTF-belt 24 upstream from and close to the transfuse nip 27.

As above noted, in the prior art, it is known to heat the TTF-belt 24 by heating from the inside of the belt 24 for example with a radiation heater 31 (exemplary shown by a dotted line in FIG. 3 because it is not part of the present embodiment). A disadvantage hereof is that the belt needs to be throughly heated in order to reach the desired outer surface temperature. It is then virtually impossible to deliver heat on demand because the required time to reach the desired external fusing surface temperature is too long. It also takes much longer for the belt 24 to cool down, which would be disadvantageous when a compact construction of the apparatus would be desired, taking into account that a relatively low transfer temperature is needed at the transfer nip 30.

A solution for this problem is found in only heating the (external) fusing surface of the TTF-belt 24, close to the transfuse nip 27 such that only a relatively small amount of heat is lost to the surroundings and mass of the TTF-belt 24 between heating the external fusing surface and arrival at the transfuse nip 27. This means that an angle $\alpha$ (as indicated in FIG. 3) is preferably selected to be small.

FIG. 3 shows that the construction of the apparatus according to this embodiment is very compact, which makes it difficult to provide heat close to the transfuse nip 27 with direct radiation heat. Another disadvantage of providing direct radiation heat is that also other parts of the apparatus may unintentionally be heated, which is inefficient.

The heating device 20 comprises a reflector assembly for focusing the heat radiation on the fusing surface of the TTF-belt 24 close to and upstream from the transfuse nip 27. The heating device is arranged such that the second focal line 6' (FIG. 2B) and the mirror image of the fourth focal line—in this embodiment substantially coinciding with the second focal line—are located on the TTF-belt 24 at the angle $\alpha$ from the transfuse nip 27. Thus, heat is provided on demand, close to the transfuse nip 27. In FIG. 3, i.e. a cross-sectional representation of the apparatus according to the present embodiment, the second and fourth focal lines are represented by the second focal point 6.

Besides a longitudinal radiation source 5, arranged at the first focal line 4' (FIG. 2B) of the first reflector section 1, a second radiation source 21 may be arranged at one or each end section of the heating device. Such a radiation source may be arranged for compensating for the excess heat loss and/or inefficient radiation by the longitudinal radiation source 5 at the lateral end section of the radiated surface, which in this particular example is a part of a TTF-belt 24. The purpose of the second radiation source 21 may therefore be providing additional heating of a lateral end section of a fuse belt 24. For this purpose, the second radiation source 21 does not necessarily need to be arranged at the first focal point 4. It is noted that the second radiation source 21 is optional and that a third radiation source may for similar reasons be arranged at the end section of the heating device opposite to the end section at which the second radiation source may be located.

It is noted that the elements forming the reflector assembly may become relatively hot, since not all radiation will in practice be reflected. In an advantageous embodiment, the reflector elements are provided with cooling means such as a black outer surface, cooling ribs and other well known features for increasing a heat transfer to the surroundings. In a particular advantageous embodiment, the heat to be transferred from the reflector elements is re-used in other elements. For example, it is contemplated that the heat to be transferred from the third reflector section 3 may be used for heating the recording medium in the preheating station, e.g. for heating the transport belt 22.

Further, it is noted that in a practical embodiment it may be advantageous that the heat radiation source 5 is not positioned exactly in the first and third focal point of the reflector assembly. Due to manufacturing tolerances, and the like, the above described ideal geometry may not be obtained, for example. Therefore, and possibly for other reasons, the heat transfer to the surface of the fusing element, in the present embodiment the TTF-belt 24, may be optimized by positioning the radiation source 5 slightly offset from said focal points. However, herein, it is considered that the radiation source 5 is then still positioned substantially in the first and third focal points.

Figure 4:
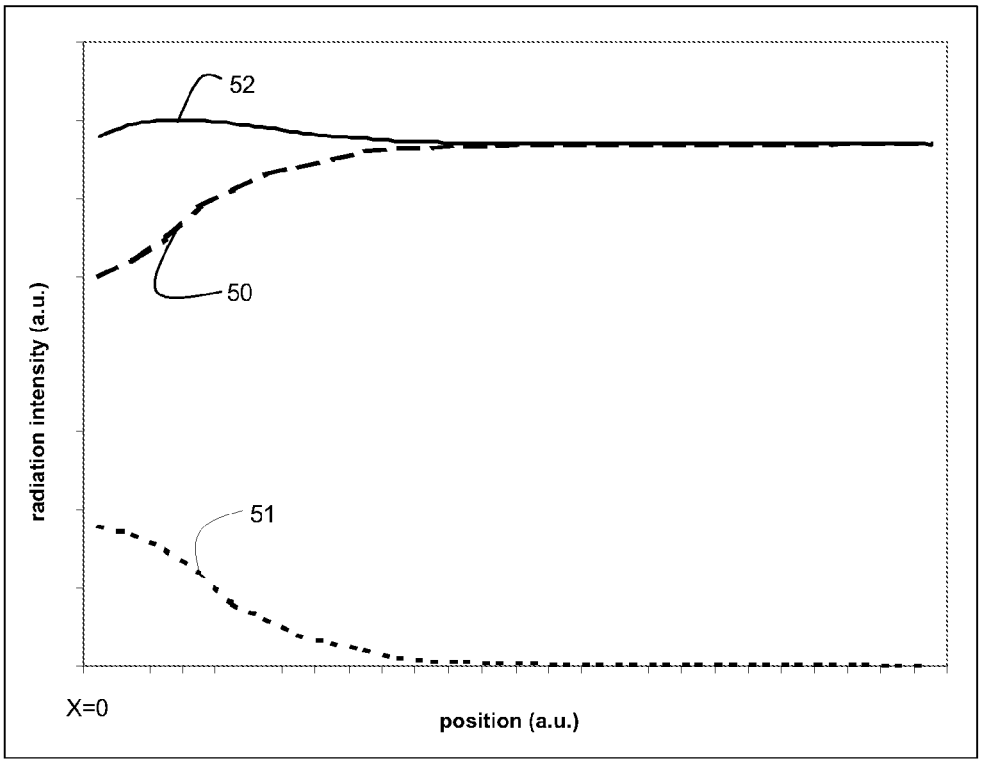
FIG. 4 shows an exemplary axial power distribution on a surface of a fusing element in accordance with an embodiment of the present invention.
Figure 5:
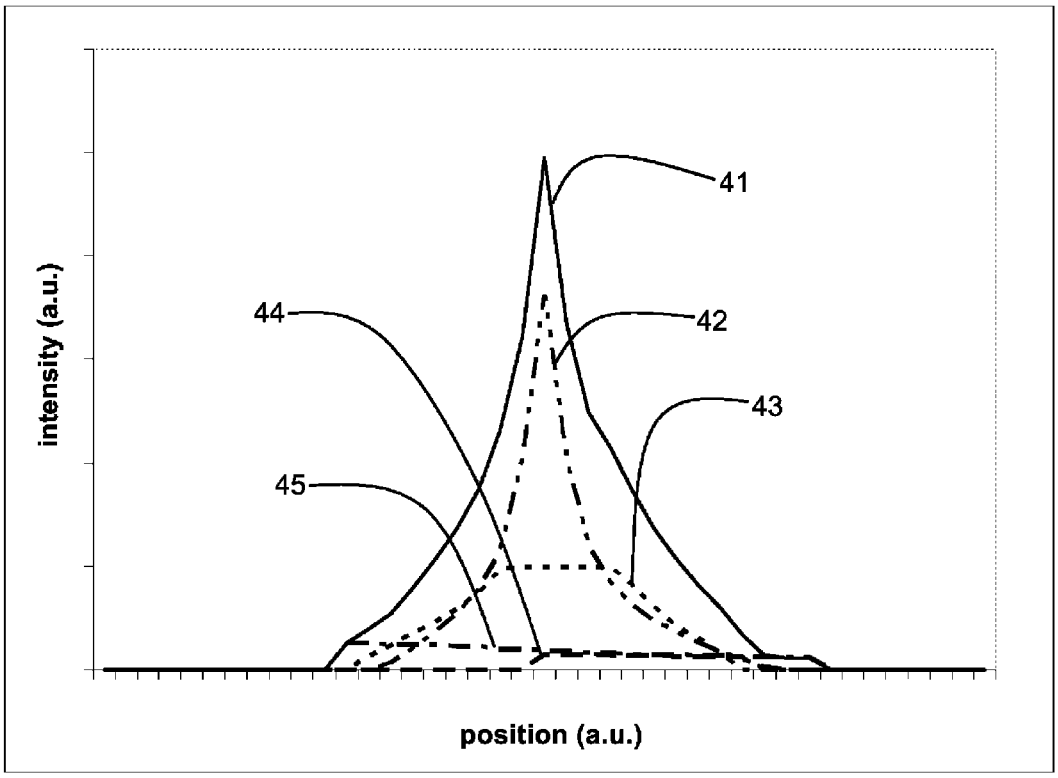
FIG. 5 shows an exemplary spatial radiation power distribution on a heated surface.

FIG. 4 shows an exemplary radiation intensity distribution (vertical axis) on the heated surface of the TTF-belt, relative to an axial position on the TTF-belt (horizontal axis), i.e., an axial position relative to the lateral end section (x=0) of the TTF-belt which may be heated by the second radiation source (see FIG. 2B). The curve indicated with number 50 shows the axial radiation intensity distribution as received by the TTF-belt that is only radiated with the longitudinal radiation source 5. It can be seen that the received radiation intensity decreases near the lateral end section of the TTF-belt. The contribution of the second radiation source 21 to the received axial radiation intensity distribution is shown by curve 51. FIG. 5 shows that the decrease in the received radiation intensity near the lateral end section of the TTF-belt may be well compensated by the second radiation source 21, as shown by the curve representing the total axial radiation intensity distribution 52.

FIG. 5 shows an exemplary spatial radiation power distribution (vertical axis), relative to a position (horizontal axis) on the heated surface of fuse belt 24 (FIG. 3). The radiation generated by the radiation source 5 reaches the surface of fuse belt 24 in at least four different ways, which will be discussed below.

The total power distribution is indicated by a solid curve 41. A first portion of the radiation reaches the belt after a single reflection on the first reflector section, as indicated with radiation rays 7 in FIG. 1. The contribution of this first portion of the radiation is indicated by a dash-dotted curve 42. It is apparent that this is a significant contribution to the total power distribution 41. It is also apparent that this portion is well focused in a rather small region on the belt, in particular focused in the second focal point 6 of the first elliptical reflector section 1 (see FIG. 2A and FIG. 3).

A second portion of radiation, indicated by dotted curve 43, is reflected twice before reaching the surface of the fuse belt: first on the second reflector section 2, followed by reflection on the third reflector section 3. The contribution of this radiation portion is in this case smaller than the contribution of the first portion, but still significant and rather well focused towards the second focal point of the first reflector 1, which reflector does not contribute to the reflection of the second radiation portion.

The contribution of a third portion of radiation, indicated by dashed curve 44, which portion of radiation is only reflected on the third reflector section 3, is small in magnitude and the centre of this portion is slightly shifted from the location of the second focal point of the first reflector, which is substantially located at the maximum of the curve 42, which curve represents the first portion of radiation.

A fourth portion of the radiation, indicated by dash-dotted curve 45, reaches the fuse belt directly from the source, without any reflection. This portion reaches a broad spatial region on the belt, but is rather small in magnitude.

As above-mentioned, the overall power distribution on the surface of the fuse belt 24 is indicated with number 41. The maximum of this curve 41 substantially coincides with the maximum of curve 42, which also shows that the sum of the radiation portions as described above, is well focused towards the second focal point 6 of the first reflector section 1.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any combination of such claims are herewith disclosed. Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention claimed is:

1. A method for fusing a recording material on a medium, the method comprising the steps of:

a) generating heat radiation;

b) focusing the heat radiation in a narrow region of a fusing surface of a fusing element close to and upstream from a fusing nip for heating said fusing surface to a fusing temperature; and c) fusing the recording material onto the medium by transporting the medium and the recording material through the fusing nip, in which the medium and the recording material are brought into contact with the fusing surface of the fusing element, wherein the method further comprises, prior to step a), the steps of:

d) transferring the recording material to the fusing surface of the fusing element, the fusing surface of the fusing element having a transfer temperature, the transfer temperature being lower than the fusing temperature; and e) the fusing element transporting the recording material to the fusing nip.

2. The method according to claim 1, wherein step b) comprises focusing the heat radiation using an elliptical reflector.

3. An apparatus for fusing a recording material on a receiving medium, the apparatus comprising:

a) a moveably arranged fusing element having a fusing surface;

b) a pressure roller arranged in operative coupling with the fusing element to form a fuse nip;

c) a heating device for providing heat radiation to the fusing element, the heating device comprising a heat radiation generating element being arranged such that the heat radiation is provided on the fusing surface of the fusing element close to and upstream from the fuse nip and the fusing surface is brought into contact with the recording material and the receiving medium for fusing the recording material on the receiving medium, wherein the heat device further comprises a reflector assembly, a cross-section of the reflector assembly comprising:

a first elliptical reflector section having a first focal point and a second focal point;

a second elliptical reflector section having a third focal point and a fourth focal point; and a third reflector section arranged for reflecting a portion of radiation first reflected by the second reflector section, wherein the first, second and third reflector sections are arranged such that the first focal point and the third focal point substantially coincide and such that the third reflector section mirrors the fourth focal point substantially towards the second focal point and such that the second focal point and the mirror image of the fourth focal point are substantially located on the fusing surface of the fusing element close to and upstream from the fuse nip.

4. The apparatus according to claim 3, wherein the third reflector section is a plane shaped reflector section.

5. The apparatus according to claim 3, wherein the reflector assembly further comprises a fourth, circularly shaped reflector section, the fourth reflector section being mounted such that a centre of its circular shape substantially coincides with the first focal point and with the third focal point.

6. The apparatus according to claim 3, wherein the heat radiation generating element is located substantially at the first focal point and at the third focal point.

7. The apparatus according to claim 3, wherein the heating device extends in a first direction from a first end section to a second end section and wherein the heating device further comprises at least one further radiation source, the at least one further radiation source being arranged at one of said first and second end section.

8. The apparatus according to claim 3, wherein the fusing element is a fuse roller.

9. The apparatus according to claim 3, wherein the fusing element is a fuse belt stretched around at least two rollers.

10. The apparatus according to claim 4, wherein the reflector assembly further comprises a fourth, circularly shaped reflector section, the fourth reflector section being mounted such that a centre of its circular shape substantially coincides with the first focal point and with the third focal point.

11. The apparatus according to claim 4, wherein the heat radiation generating element is located substantially at the first focal point and at the third focal point.

12. The apparatus according to claim 5, wherein the heat radiation generating element is located substantially at the first focal point and at the third focal point.

13. The apparatus according to claim 4, wherein the heating device extends in a first direction from a first end section to a second end section and wherein the heating device further comprises at least one further radiation source, the at least one further radiation source being arranged at one of said first and second end section.

14. The apparatus according to claim 5, wherein the heating device extends in a first direction from a first end section to a second end section and wherein the heating device further comprises at least one further radiation source, the at least one further radiation source being arranged at one of said first and second end section.

15. The apparatus according to claim 6, wherein the heating device extends in a first direction from a first end section to a second end section and wherein the heating device further comprises at least one further radiation source, the at least one further radiation source being arranged at one of said first and second end section.

16. The apparatus according to claim 3, wherein the fusing element is a fuse roller.

17. The apparatus according to claim 4, wherein the fusing element is a fuse roller.

18. The method according to claim 1, wherein the fusing element has an opposite surface opposite to the fusing surface, and the method further comprising placing a heating device at a same side at which the fusing surface of the fusing element faces, thereby generating and providing the heat radiation to the fusing surface of the fusing element.

19. The apparatus according to claim 3, wherein the fusing element has an opposite surface opposite to the fusing surface, and the heating device is located at a same side at which the fusing surface of the fusing element faces, thereby generating and providing the heat radiation to the fusing surface of the fusing element.

* * * * *